US011688261B2

(12) United States Patent
Schorey et al.

(10) Patent No.: US 11,688,261 B2
(45) Date of Patent: Jun. 27, 2023

(54) BODY-WORN ALERT SYSTEM

(71) Applicant: SentinelWear LLC, Milford, OH (US)

(72) Inventors: James E. Schorey, Milford, OH (US); Benjamin Kamen, Champaign, IL (US)

(73) Assignee: SentinelWear LLC, Milford, OH (US)

( * ) Notice: Subject to any disclaimer, the term of this patent is extended or adjusted under 35 U.S.C. 154(b) by 0 days.

(21) Appl. No.: 17/322,308

(22) Filed: May 17, 2021

(65) Prior Publication Data

US 2021/0358285 A1 Nov. 18, 2021

Related U.S. Application Data

(60) Provisional application No. 63/026,672, filed on May 18, 2020.

(51) Int. Cl.
*G08B 21/02* (2006.01)

(52) U.S. Cl.
CPC ..... *G08B 21/0225* (2013.01); *G08B 21/0208* (2013.01); *G08B 21/0211* (2013.01); *G08B 21/0269* (2013.01); *G08B 21/0277* (2013.01); *G08B 21/0294* (2013.01)

(58) Field of Classification Search
CPC ..... G08B 21/0225
See application file for complete search history.

(56) References Cited

U.S. PATENT DOCUMENTS

| | | | | |
|---|---|---|---|---|
| 4,598,272 | A * | 7/1986 | Cox | G08B 21/0247 340/8.1 |
| 2003/0030561 | A1* | 2/2003 | Yafuso | G08B 21/0227 340/573.4 |
| 2012/0086557 | A1* | 4/2012 | Inatomi | G07C 1/26 340/10.3 |
| 2015/0109126 | A1* | 4/2015 | Crawford | G08B 21/0269 340/539.13 |
| 2019/0043329 | A1* | 2/2019 | Fitzpatrick | G08B 21/0288 |
| 2019/0051132 | A1 | 2/2019 | Shepard | |
| 2019/0058970 | A1 | 2/2019 | Baker et al. | |
| 2019/0213860 | A1 | 7/2019 | Shaprio et al. | |
| 2019/0347920 | A1 | 11/2019 | Anderson et al. | |
| 2020/0066131 | A1 | 2/2020 | Gross | |
| 2020/0110147 | A1 | 4/2020 | Smith | |
| 2020/0383381 | A1 | 12/2020 | Smith et al. | |
| 2020/0394886 | A1 | 12/2020 | Antar et al. | |
| 2020/0402386 | A1 | 12/2020 | Peterson et al. | |
| 2021/0035429 | A1* | 2/2021 | Daoura | G08B 21/0294 |

* cited by examiner

*Primary Examiner* — Travis R Hunnings
(74) *Attorney, Agent, or Firm* — Jenei LLC

(57) ABSTRACT

A method and system are described for automated child monitoring. The system comprises wearable sensor device wirelessly connected to a mobile device. The system comprises sensors configured to detect environmental factors and activities of a child. In one or more embodiments, the activities may be one or more of drinking, vaping, smoking, driving and presence of a threat for a child. The system may be configured to determine real-time location of a wearer as well as contextual information. The sensor device is communicably coupled to one or more mobile devices, additional wearable devices or fixed units. The mobile device is configured to control one or more operations of the inconspicuous wearable device.

16 Claims, 6 Drawing Sheets

Automated child monitoring system 100

FIG. 1: Automated child monitoring system 100

FIG. 2: Inconspicuous wearable device 102

FIG. 3: Remote device 106

FIG. 4 Method 400 for monitoring an activity of a child

BODY-WORN ALERT SYSTEM

CROSS-REFERENCE TO RELATED APPLICATIONS

The present Application for Patent claims priority to U.S. Provisional Application No. 63/026,672 entitled "BODY-WORN ALERT SYSTEM" filed 18 May 2020, which is hereby expressly incorporated by reference herein.

BACKGROUND

1. Technical Field

The present subject matter is related, in general, to a child monitoring system for use by parents or guardians, and more particularly, but not exclusively to a method and a system for detecting one or more activities being performed by a child and any threats associated with such activities.

2. Description of the Related Art

In recent years, healthy parenting has been a major issue faced by parents residing globally. Furthermore, activities such as smoking, drinking, vaping and so forth have severely affected the health of the youth and teenagers. Additionally, careless activities such as unsafe driving, carrying passengers in personal cars without permission, and such like activities are prone to hazardous situations and may result in accidents or health issues. Therefore, there is a need to protect the child from performing the aforementioned activities.

A number of child monitoring devices have been devised for maintaining surveillance on children, for example, who wander from a particular area or domain. It has become increasingly difficult for parents and/or guardians to monitor a single child or groups of children by human effort alone. The increase of lost children in shopping malls, play areas, or area kidnappings, within the United States alone has been cause for developing auxiliary measures or devices for parents or guardians to detect and retrieve children who have left a particular area. The advent of these devices began with the rudimentary methods of announcing over a loudspeaker, particularly in shopping malls, that a child has been found and is at a particular location for pickup by a parent or guardian.

In recent years, several advancements have been made to monitor day-to-day activities of children either in schools or on roads. Such practices include smoke sensors in washrooms or corner areas, cameras on the campus, and so forth. However, such practices are still inefficient in controlling the activities of the child such as skipping school, performing unhealthy or unsafe activities when away from guidance. Therefore, several devices have been introduced for real-time monitoring of the child. In such a case, the monitoring devices are placed in proximity of the child to obtain real-time monitoring data. However, there are limitations with such devices as the devices are unable to avoid or discourage the child from performing such activities, due to their evident appearance on a person.

Parents may have difficulty keeping track of their children in a crowded public place. Children may not be old enough to use a mobile device, such as a cell phone, for communicating with their parents. Thus, the parent must constantly monitor the child in order to prevent the child from becoming lost. However, it can be difficult or impossible for a parent to monitor a child at all times. Thus, a wearable device that allows a parent and a child to remain in contact and that allows the parent to monitor the child's activity and location is desired.

None of the state-of-the-art child monitoring systems, taken either singly or in combination, is seen to describe the present invention as claimed. Thus, a child monitoring system that detects activities of a child using sensors and alerts the parent when the child is performing a harmful activity such as, drinking, smoking, vaping, and like or if the child is in a dangerous situation is desired. Further, a child monitoring system is desired that can communicated with the child and discourage the child from performing such harmful activities.

Further limitations and disadvantages of conventional and traditional approaches will become apparent to one of skill in the art, through comparison of described systems with some aspects of the present disclosure, as set forth in the remainder of the present application and with reference to the drawings.

BRIEF SUMMARY OF THE INVENTION

The foregoing summary is illustrative only and is not intended to be in any way limiting. In addition to the illustrative aspects, embodiments, and features described above, further aspects, embodiments, and features will become apparent by reference to the drawings and the following detailed description.

According to embodiments illustrated herein, there may be provided an automated monitoring system for monitoring activities of a child or other person of interest. The automated child monitoring system may comprise an inconspicuous, wearable device and a remote device. The wearable device may comprise a hardware processor and a memory communicatively coupled to the hardware processor. The wearable device may further comprise a speaker configured to play an audio received from a remote device via a transceiver. The wearable device may further comprise a microphone configured to record audio within a predefined distance of a child. In an embodiment, the wearable device is wearable by the child. The wearable device may further comprise one or more sensors configured to detect one or more activities of the child. In an embodiment, the one or more activities comprises at least one of: drinking, vaping, smoking, a presence of a threat for the child.

The wearable device may further comprise a GPS unit configured to determine real-time location of the child. In an embodiment, the remote device is communicably coupled to the inconspicuous wearable device. In an embodiment, the remote device is configured to control one or more operations of the inconspicuous wearable device. In an embodiment, the remote device is configured to generate a real-time report of the child's activities and further provide one or more alarms to a user of the remote device.

According to one or more embodiments illustrated herein, there may be provided a method for monitoring an activity of a child. The method may be performed by an automated child monitoring system. The method may include detecting one or more activities of the child using one or more sensors. In an embodiment, the one or more sensors comprises temperature sensor, blood pressure sensor, smoke sensor, proximity sensor, noise sensor, and imaging sensor. The method may include identifying a real-time location of the child.

In one or more embodiments, the methods may include identifying the context of the situation or environment of the child or subject.

It is also an object of the present invention to provide the aforementioned system, wherein the sensor means is selected from the group consisting of: a motion detector sensor, a temperature detector sensor, oxygen level sensor, $CO_2$ level sensor, voice detector, volume detector, mass detector, vital signs detector, sound detector, light/laser detector, pressure sensor, air exchange detector and any combination thereof.

It is also an object of the present invention to provide the aforementioned method, wherein additionally comprising step of displaying via display means indication of at least one indication selected from the group consisting of: vehicle measured parameters, vehicle location, vehicle temperature, time, presence of an occupant in a vehicle and any combination thereof.

It is also an object of the present invention to provide the aforementioned method, wherein the step of sensing at least one parameter selected from the group consisting of: vehicle measured parameters, vehicle location, vehicle temperature, time, presence of an occupant in a vehicle and any combination thereof.

Yet another object of the embodiments herein is to provide a system and method to disable texting, messaging or initiating calls from a mobile communication device of a driver while allowing texting, messaging and making calls from the mobile communication device of the passengers in a vehicle.

Yet another object of the embodiments herein is to provide a system and method to enable the slave modules in the safety zone to function jointly or independently from eth master module to synchronize and function with any smart devices positioned within the safety zone to ensure integrity and accuracy of signals between the driver's smart devices within safety zone to prevent signal distortion from any outside sources.

Yet another object of the embodiments herein is to provide a system and method to assess and recognize an occupancy number of passengers in an operating vehicle in order to adjust safety zone with respect to an occupancy level thereby enlarging safety zone limit beyond driver seat, when the occupancy is limited to driver only, to disable any smart device in the coverage area of safety zone, or to limit the safety zone within the area of a driver and driver seat during a vehicle operation, in the presence of passenger(s).

Unlike vape detection systems installed in school restrooms, for example, the body-worn nature of the device will ensure the user is always monitored. The significant intellectual property advantage to the system is that it will track physiological markers from the wearer as well as monitor volatile organic compounds (VOCs) and environmental sensor data in the vicinity of the wearer. This combination will greatly improve the accuracy and the tamper-proof nature of the device. Telemetry from the wearable device may be tied to a hub managing multiple wearable device units or to a smart phone for an individual wearable device unit. In either case, cloud-based algorithms will assign a probability that the wearer was vaping or was in the vicinity of vaping. The school, parent, or guardian would have an accompanying App on the hub or on an Android or iOS device to monitor the wearer's vaping behavior—with alarms and other notifications built in as needed.

In one embodiment, the wearable device further comprises anti-tampering sensors or tampering-detection software. In one embodiment, the wearable device monitors one or more of ambient noise, ambient light or background airflow in order to detect when one or more sensors are blocked from detecting activities such as smoke or vapor. While is still possible for a person to tamper with, and impair, the operation of a wearable sensor, anti-tampering features can be more easily incorporated into the design a wearable device than a non-wearable device. For example, a wearable sensor may trigger an alarm, or other response, if it removed from placement. Sensor blockage contact can be monitored using electromagnetic, pressure, motion, and/or sound sensors. In an example, a wearable motion sensor may trigger an alarm, or other response, if there is a lack of motion that is not also accompanied by specific indications of sleeping activity. In an example, a wearable sound sensor may trigger an alarm or other response if there is a lack of sounds that are normally associated with proximity to the person's body. In an example, a wearable imaging sensor may trigger an alarm, or other response, if there is a lack of images (such as a light sensor) that are associated with proper positioning.

In one embodiment, the wearable device is a body-worn devices to deter students from vaping in the first place. In the event of an active shooter situation, the sensors in the device and the ability to network them will give school administration and first responders real-time location information of the shooter and students. In another embodiment, the wearable device has a built-in haptic transducer (vibrator), allowing silent communication with the students to send predetermined messages such as "all clear."

In another embodiment, the wearable device is designed to be sensor rich and application agnostic, meaning the same device could be used as the platform for one or more threat assessment software applications.

In another embodiment, no personal data is stored on the wearable.

In another embodiment, the sensor data from the wearable device is uploaded to an internet-connected server and processed to identify parameters such as sound, VOC, movement, noise and other "signatures" for determining the nature of the wearer's day. See FIGS. 5-6.

In another embodiment, the wearable device comprises software applications that are selectable by the user or parent/guardian. These choices can range from one to many applications. For example, if a parent is only concerned that the child is wearing a bike helmet at all times, the wearable device can be loaded with only the helmet detecting application.

In another embodiment, the wearable device comprises sensors and software applications capable of monitoring VOCs and dissuade the wearer from activities such as smoking and vaping.

In another embodiment, the wearable device comprises sensors and software applications capable of monitoring VOCs to detect smoking or vaping and incorporates context that includes time of day, place, and the child's physiological markers. In another embodiment, the wearable device overlays context from a school system's hub or a family's smart phone and add cloud-based computations to determine with a high-degree of certainty that vaping has taken place. When phones are turned off, or when there is no Wi-Fi, the wearable device will still log time-stamped environmental data to be overlaid with time-place-physio context once the phones and the network services (cellular or Wi-Fi) are back in operation.

In another embodiment, the wearable device comprises sensors and software applications capable of triangulating the position of an active shooter and to give law enforcement and school officials a clear picture of where the shooter is and where the students are.

In another embodiment, the wearable device comprises sensors and software applications along with the ability to mesh-network with other in-range wearable device units to formulate a dynamic record of the shooter's movement. The data from multiple wearable device units is transmitted via a Bluetooth mesh network to a host device. The host device uses data from individual wearable device units, data that includes sound volume and time of day, to "map" the ongoing position of the shooter. The haptic transducer in the wearable device silently lets the wearer know when to shelter in place or when to leave the immediate vicinity for nearby help. "Mesh network" is a wireless local area network (WLAN) in which nodes on the network (e.g., wearable devices and hubs) are connected to each other.

Software programs associated with the Internet-accessible website, secondary software system, and the personal computer analyze the sensor input values to characterize the user's condition or environment. These programs, for example, may provide a report that features statistical analysis of these data to determine averages, data displayed in a graphical format, trends, and comparisons to recommended values. When the wearable device cannot communicate with the network, the wearable device simply stores information in memory and continues to make measurements. The wearable device automatically transmits all the stored information (along with a time/date stamp) when it comes in proximity to the wireless network, which then transmits the information through the wireless network. In one embodiment, the server provides web services that communicate with third party software through an interface.

In another embodiment, the wearable device comprises sensors and software applications capable of detecting whether or not young drivers have passengers occupying a vehicle.

In another embodiment, the wearable device comprises sensors and software applications capable of verifying that a child is wearing a bicycle helmet when cycling.

In another embodiment, the wearable device stores no personal data. Its function is straightforward: collect as much time-stamped sensor data as possible throughout the day so that later, when the wearable device is paired with a designated secure hub, the data can be uploaded. It is only at this one secure point that the wearable data is matched to the student. Think of this like a locked school administration room containing student files with report cards, notes on parent-teacher meetings, etc. Once the data is at the hub, it is then be analyzed. This is a matter of sending the sensor data and context to the wearable device cloud to chart the wearer's behavior through the day (e.g., did he vape, was he in the vicinity of vapers, etc.). Notably, nothing sent to the cloud has identifying information; that is, a rogue entity, even assuming the transmission was decryptable, could not determine the identity of the student or the location of the school to which that data belonged. In the same manner, if the wearable device is tied to a parent's phone, only that phone would have the ability to match the data from the wearable device to the identity of the wearer.

In another embodiment, a database (e.g. in local server, hub device, cloud server, storage network, etc.) may be used to store the characteristics, spatial-temporal information, signatures, patterns, behaviors, trends, parameters, analytics, identification information, user information, device information, channel information, venue (e.g. map, network, proximity devices/networks) information, task information, class/category information, presentation (e.g. UI) information, and/or other information.

Thresholds and configurable data may be modifiable for a specific person. Also, the thresholds and configurable data may be modifiable for a type of range of activities or environments. Further, the thresholds and configurable data may be modifiable as a result of contextual information relating to a person.

The configurable data is derivable from previous analysis and/or comparison of other information and the thresholds. Advantageously, the signaled indication may be capable of being overridden or reduced in severity by additional contextual information experienced by a person. Contextual information may relate to one or more of a) whether a person is moving; b) location of the person; c) whether a person is carrying out a specific activity; d) the current or recent environmental factors experienced; or e) time and date. Environmental factors may include a) ambient temperature, pressure or humidity; b) detected VOCs; or c) relative motion of the person. Preferably, the sensitivity of detection may be modifiable in response to the activity status or environmental factors detected by the monitoring device, and/or contextual information experienced by a person.

The method may include determining one or more threats that are within nearby surroundings of the child based on the detected one or more activities and the real-time location of the child. The method may include generating a real-time report of the child. In an embodiment, the real-time report comprises information about the detected one or more activities of the child, the real-time location of the child over a time period, and the determined one or more threats. The method may include transmitting the real-time report of the child to a cloud server.

BRIEF DESCRIPTION OF THE DRAWINGS

The accompanying drawings, which are incorporated in and constitute a part of this disclosure, illustrate exemplary embodiments and, together with the description, serve to explain the disclosed principles. In the figures, the left-most digit(s) of a reference number identifies the figure in which the reference number first appears. The same numbers are used throughout the figures to reference like features and components. Some embodiments of system and/or methods in accordance with embodiments of the present subject matter are now described, by way of example only, and with reference to the accompanying figures, in which.

Figure 1:
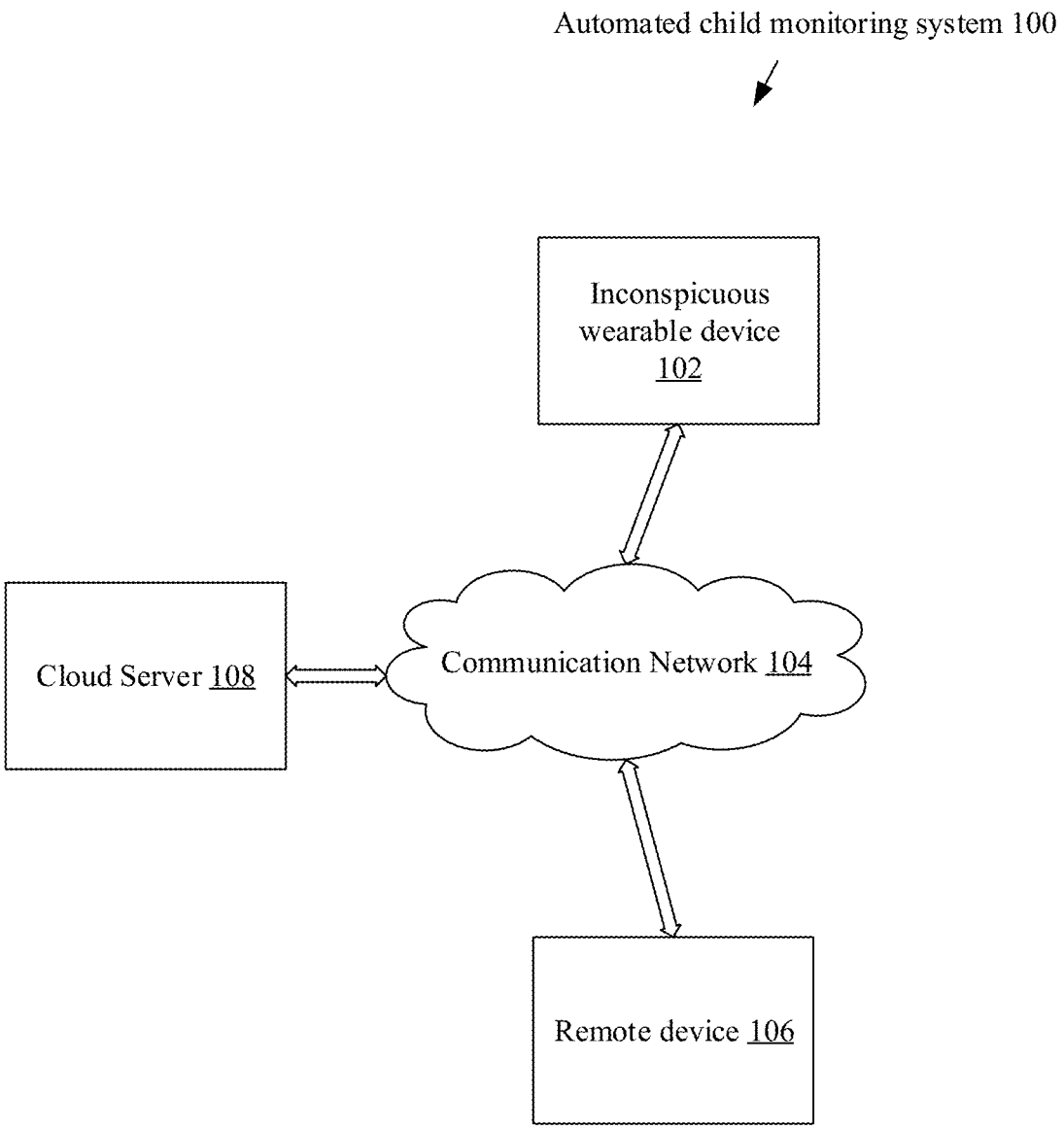
FIG. 1 is a block diagram that illustrates an automated child monitoring system in which various embodiments of the method and the system may be implemented.

It should be appreciated by those skilled in the art that any block diagrams herein represent conceptual views of illustrative systems embodying the principles of the present subject matter. Similarly, it will be appreciated that any flow charts, flow diagrams, state transition diagrams, pseudo code, and the like represent various processes, which may be substantially represented in computer readable medium and executed by a computer or processor, whether or not such computer or processor is explicitly shown.

DETAILED DESCRIPTION

The present disclosure may be best understood with reference to the detailed figures and description set forth herein. Various embodiments are discussed below with reference to the figures. However, those skilled in the art will readily appreciate that the detailed descriptions given herein with respect to the figures are simply for explanatory purposes as the methods and systems may extend beyond the described embodiments. For example, the teachings presented and the needs of a particular application may yield multiple alternative and suitable approaches to implement the functionality of any detail described herein. Therefore, any approach may extend beyond the particular implementation choices in the following embodiments described and shown.

References to "one embodiment," "at least one embodiment," "an embodiment," "one example," "an example," "for example," and so on indicate that the embodiment(s) or example(s) may include a particular feature, structure, characteristic, property, element, or limitation but that not every embodiment or example necessarily includes that particular feature, structure, characteristic, property, element, or limitation. Further, repeated use of the phrase "in an embodiment" does not necessarily refer to the same embodiment.

In one aspect, embodiments of the present invention provide an automated child monitoring system for monitoring an activity of the child, the automated child monitoring system comprises a wearable device to be worn by the child; the wearable device comprises a sensor arrangement to detect the activity of the child; a microprocessor communicably coupled to the sensor arrangement; a network interface configured to transmit a signal indicating a pre-determined signal threshold; and a remote device operatively coupled to the inconspicuous wearable device; wherein the remote device comprises an application software module configured to operate the inconspicuous wearable device.

In another aspect, embodiments of the present invention provide an automated child monitoring system for monitoring an activity of the child comprising a wearable device to be worn by the child; wherein the wearable device comprises a contextual information. In one aspect, the contextual information includes time of day, place, and the child's physiological markers. In one embodiment, the system can overlay context from a school system's hub or a family's smart phone and add cloud-based computations to determine with a high-degree of certainty that a pre-determined signal threshold has been reached. When mobile devices are turned off, or when there is no Wi-Fi, the system will still log time-stamped environmental data to be overlaid with time-place-physio context once the mobile device and/or network services (cellular, Bluetooth, Wi-Fi or other wireless communication system) are back in operation.

In another embodiment, the system comprises the systems to mesh-network with other in-range wearable device units to formulate a dynamic record of a user or other person's (e.g., an active shooter) movement. The data from multiple wearable device units is transmitted via a wireless mesh network to a host device. The host device uses data from individual wearable device units, data may include sound signatures and volume, time of day, location data, etc., in order to map the ongoing position of the individual or shooter. In another embodiment, the system comprises a haptic transducer in the wearable device to alert the wearer of certain actions such as when to shelter in place or when to leave the immediate vicinity for nearby help.

In another embodiment, an identification system for identifying vaping or other smoking activities includes a sensor system disposed at a site and a controller coupled to the sensor system via a network. The sensor system includes an air quality sensor configured to detect air quality, a sound detector configured to detect sounds, and a network interface configured to transmit a signal indicating abnormality matching signature of vaping, other smoking activity, or sound of gunshots. The controller is configured to identify vaping or another smoking activity based on the sensed air quality, to identify gunshots based on the detected sounds, and to send an alert to a user. In another aspect, the detected sounds may be used to identify sleep apnea. In another aspect, the detected sounds may be used to identify bullying. In one aspect, the alert is a text message, an email, an optical flashing, an audible sound, or combination thereof.

In one aspect, embodiments of the present invention provide an automated child monitoring system for monitoring an activity of the child, the automated child monitoring system comprises a wearable device to be worn by the child; the wearable device comprises a sensor arrangement to detect the activity of the child; a GPS unit for identifying a location of the child; and a microprocessor communicably coupled to the sensor arrangement and the GPS module; a remote device operatively coupled to the inconspicuous wearable device; the remote device comprises an application software module configured to operate the inconspicuous wearable device; and an alarming module to establish a real-time report of the child.

In the second aspect, embodiments of the present invention provide a method for monitoring an activity of a child; the method comprises detecting an activity of the child; identifying a location of the child; sensing nearby surroundings of the child; and establishing a real-time report of the child.

Throughout the present invention, the term "child" as used herein refers to a human being or an animal. In one or more embodiments, the present invention focuses on the teenage group, generally in the age group from 13 years to 19 years and/or up-to 21 years. In one embodiment, the teenage age group is meant to be under guidance to avoid getting into unhygienic activities such as smoking, drinking, and the like. Furthermore, a healthy and secure lifestyle requires effective monitoring of the day to day activities performed by teenagers. Moreover, the day to day activities involves eating and drinking habits, involvement in surroundings, relations at schools, colleges and so forth. In general, teenagers are immature and may get involved in unhygienic activities such as consuming alcohol, smoking electronic cigarettes, driving vehicles with passengers onboard without permission of parents, just to income a small amount of money to perform unhygienic activities. In another instance, there may arise a threat of kidnappers, active shooters or the like to harm the children, when adults are absent.

Throughout the present invention, the term "automated" as used herein refers to self-functioning, pre-programmed, automatic, unmanned, and the like. Furthermore, the automated child monitoring system (100) as used herein may be pre-programmed with automation software configured to operate autonomously and/or may include integrated circuits that may be fabricated in a manner that performs automatically. In an example, the automated child monitoring system (100) may be programmed to autonomously perform all the activities assigned thereto.

FIG. 1 is a block diagram that illustrates an automated child monitoring system 100 in which various embodiments of the method and the system may be implemented. The automated child monitoring system 100 may include a wearable device 102, a communication network 104, a remote device 106, and a cloud server 108. The wearable device 102 may be communicatively coupled to the remote device 106, and the cloud server 108 via the communication network 104. In an embodiment, the wearable device 102, the remote device 106, and the cloud server 108 may communicate with each other via the communication network 104.

The wearable device 102 may refer to a wearable computing device. In an embodiment, the wearable device 102 is worn by the child whose activities need to be monitored by a parent of a guardian. The term "inconspicuous" as used herein refers to a chameleon to clothes worn by the child. In an instance, the wearable device (102) may include an electronic gadget such as a wristwatch, a locket, and so forth. In another instance, the wearable device (102) may be arranged with the cloth worn by the child. Particularly, the wearable device (102) is worn by the child in corresponding to a similar appearance to the fabric, as intent to duly camouflage and not clearly visible to the external participants. In an embodiment, the wearable device 102 may be configured to host an application or a software service. In an embodiment, the wearable device 102 may be implemented to execute procedures such as, but not limited to, programs, routines, or scripts stored in one or more memories for supporting the hosted application or the software service. In an embodiment, the hosted application or the software service may be configured to perform one or more predetermined operations. The wearable device 102 may be realized through various types of application servers such as, but are not limited to, a Java application server, a .NET framework application server, a Base4 application server, a PHP framework application server, or any other application server framework.

The wearable device 102 may be comprised of one or more processors and one or more memories. The one or more memories may include computer readable code that may be executable by the one or more processors to perform predetermined operations. Further, the remote device 106 may be configured to present a user-interface to the user to provide the user input. The wearable device 102 may further comprise of one or more sensors. Examples of such sensors are temperature sensor, blood pressure sensor, smoke sensor, proximity sensor, noise sensor, image sensor and the like. Further, the wearable device 102 encloses a power source, such as one or more batteries therein. In an embodiment, battery life may be be extended by shutting off circuits/sensors not part of an operation. Cost of goods can be reduced by not populating circuits/sensors not part of a particular operation.

The wearable device 102 may be configured to detect one or more activities of the child using one or more sensors. Further, the wearable device 102 may be configured to determine the real-time location of the child. Further, the wearable device 102 may be configured to receive and playback one or more guiding actions associated with the child to prevent the child from performing harmful actions/activities. Further, the wearable device 102 may be configured to provide one or more alarms to the child. In an embodiment, the alarms may be provided using at least one of: tactile feedback, audio sound, display alert.

The communication network 104 may correspond to a communication medium through which the wearable device 102, the remote device 106, and the cloud server 108 may communicate with each other. Such a communication may be performed, in accordance with various wired and wireless communication protocols. Examples of such wired and wireless communication protocols include, but are not limited to, Transmission Control Protocol and Internet Protocol (TCP/IP), User Datagram Protocol (UDP), Hypertext Transfer Protocol (HTTP), File Transfer Protocol (FTP), ZigBee, EDGE, infrared (IR), IEEE 802.11, 802.16, 2G, 3G, 4G, 5G, and 6G cellular communication protocols, and/or Bluetooth (BT) communication protocols. The communication network 104 may include, but is not limited to, the Internet, a cloud network, a Wireless Fidelity (Wi-Fi) network, a Wireless Local Area Network (WLAN), a Local Area Network (LAN), a telephone line (POTS), and/or a Metropolitan Area Network (MAN).

The remote device 106 may refer to a computing device used by a user who is a parent or a guardian of the child. As used herein, the terms "remote device" and "hub" are used interchangeably and refer to any device capable of being connected to the wearable device in order to collect data from the wearable device and/or to manage the applications and operation of the software and applications on the wearable device. "Sensor hub" or "hub" is a wireless access point that employs a processor to compile and process wireless signals (data) received from wearable devices connected to the wireless communication system. The sensor hub may be connected to the Internet, to a server and/or to separate (i.e., standalone) telecommunications device. The sensor hub may, in certain embodiments, have its own central processing unit capable of generating an alert or warning.

The remote device may be a moveable device such as a smart phone or tablet or may be a gateway that is connected to a home point-to-point network, a separate circuit board and housing that monitors communication sent by the wearable device and interfaces to a local internet hub to communicate status, hardware connected to a transmitter that provides wireless hub support, a transmitter board including components to send messages to an internet or WIFI hub to share status.

The remote device 106 may refer to a computing device or a software framework hosting an application or a software service. In an embodiment, the remote device 106 may be implemented to execute procedures such as, but not limited to, programs, routines, or scripts stored in one or more memories for supporting the hosted application or the software service. In an embodiment, the hosted application or the software service may be configured to perform one or more predetermined operations. The remote device 106 may be realized through various types of application servers such as, but are not limited to, a Java application server, a .NET framework application server, a Base4 application server, a PHP framework application server, or any other application server framework.

The remote device 106 may be comprised of one or more processors and one or more memories. The one or more memories may include computer readable code that may be executable by the one or more processors to perform predetermined operations. Further, the remote device 106 may be configured to present a user-interface to the user to provide the user input. Examples of the user computing device 102 may include, but are not limited to, a personal computer, a laptop, a personal digital assistant (PDA), a mobile device, a tablet, or any other computing device. In an embodiment, the remote device 106 may also be a wearable device, such as a smart watch and the like.

In an embodiment, the remote device 106 may be configured to control one or more operations of the inconspicuous wearable device. Further, the remote device 106 may be configured to generate a real-time report of the child and further provide one or more alarms to a user of the remote device. Further, the remote device 106 may be configured to determine a movement pattern of the child based on one or more historical locations of the child and the real-time location of the child. Further, the remote device 106 may be configured to determine a deviation of the real-time location of the child within a pre-defined time interval based on one or more pre-defined rules associated with the movement pattern. Further, the remote device 106 may be configured to provide one or more guiding actions to be transmitted to the wearable device 102. In an embodiment, one or more guiding actions discourage the child from performing unhygienic/harmful activities. Further, the remote device 106 may be configured to determine one or more threats that are within nearby surroundings of the child based on the detected one or more activities and the real-time location of the child. Further, the remote device 106 may be configured to generate a real-time report of the child. In an embodiment, the real-time report comprises information about the detected one or more activities of the child, the real-time location of the child over a time period, and the determined one or more threats.

A person having ordinary skill in the art will appreciate that the scope of the disclosure is not limited to realizing the remote device 106 and the wearable device 102 as separate entities. In an embodiment, the remote device 106 may be realized as an application program installed on and/or running on the wearable device 102 without departing from the scope of the disclosure.

The cloud server 108 may be configured to receive the real-time report of the child. Further, the cloud server 108 may be configured to store the real-time report of the child and then further transmit the report to the remote device 106.

Figure 2:
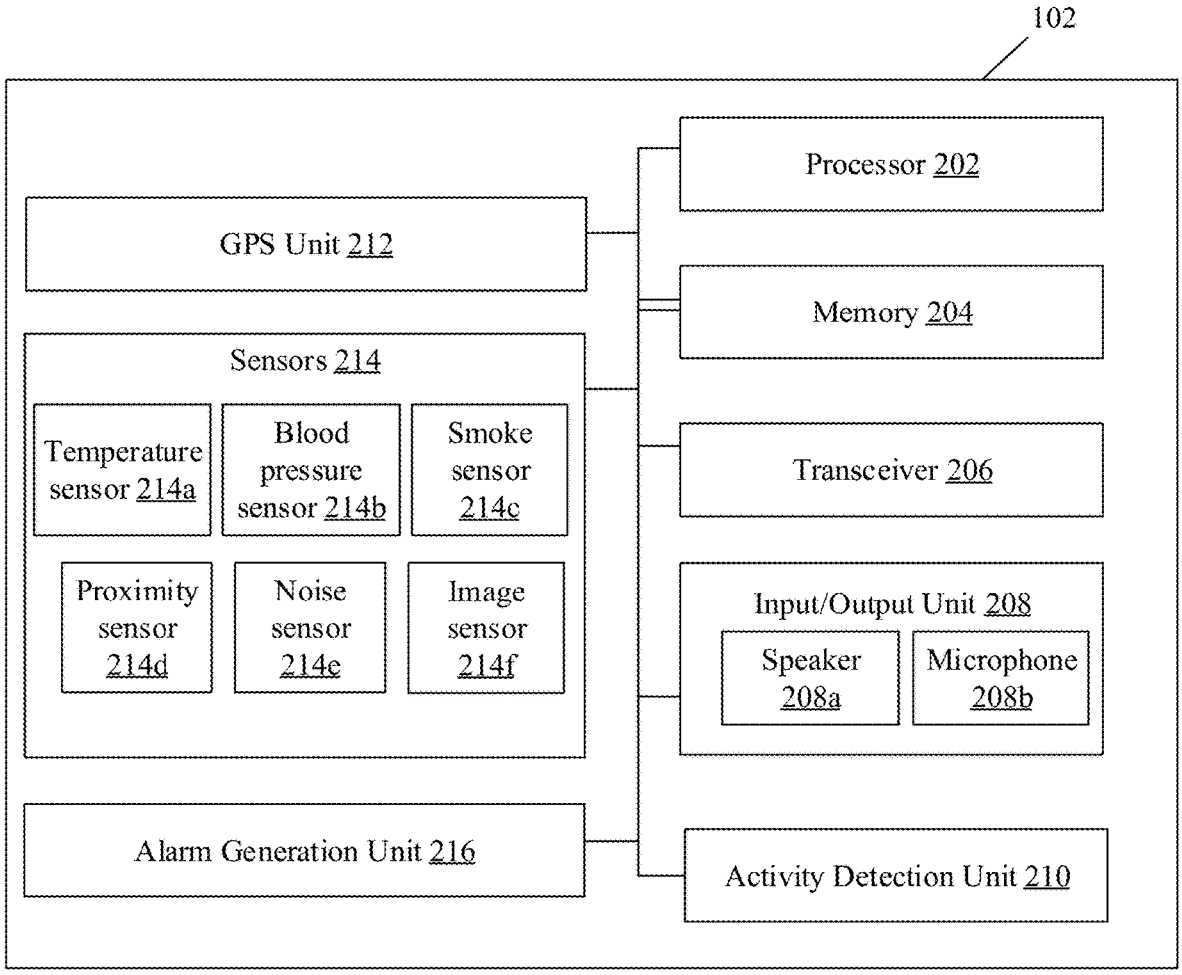
FIG. 2 is a block diagram that illustrates a wearable device configured to monitor one or more activities of a child, in accordance with some embodiments of the present disclosure.

FIG. 2 is a block diagram that illustrates a wearable device 102 configured to monitor one or more activities of a child, in accordance with some embodiments of the present disclosure.

The wearable device 102 comprises a processor 202, a memory 204, a transceiver 206, an input/output unit 208, an activity detection unit 210, a GPS unit 212, one or more sensors 214, and an alarm generation unit 216. The processor 202 may be communicatively coupled to the memory 204, the transceiver 206, the input/output unit 208, the activity detection unit 210, the GPS unit 212, the one or more sensors 214, and the alarm generation unit 216. In an embodiment, the one or more sensors 214 may comprise a temperature sensor 214*a*, blood pressure sensor 214*b*, smoke sensor 214*c*, proximity sensor 214*d*, noise sensor 214*e*, and image sensor 214*f*.

The processor 202 comprises suitable logic, circuitry, interfaces, and/or code that may be configured to execute a set of instructions stored in the memory 204. The processor 202 may be implemented based on a number of processor technologies known in the art. Examples of the processor 202 include, but not limited to, an X86-based processor, a Reduced Instruction Set Computing (RISC) processor, an Application-Specific Integrated Circuit (ASIC) processor, a Complex Instruction Set Computing (CISC) processor, and/or other processor.

The memory 204 comprises suitable logic, circuitry, interfaces, and/or code that may be configured to store the set of instructions, which may be executed by the processor 202. In an embodiment, the memory 204 may be configured to store one or more programs, routines, or scripts that may be executed in coordination with the processor 202. The memory 204 may be implemented based on a Random Access Memory (RAM), a Read-Only Memory (ROM), a Hard Disk Drive (HDD), a storage server, and/or a Secure Digital (SD) card.

The transceiver 206 comprises of suitable logic, circuitry, interfaces, and/or code that may be configured to transmit data captured by each of the one or more sensors. The transceiver 206 may be further configured to transmit real-time location of the child to the remote device. The transceiver 206 may be further configured to receive one or more guiding actions from the remote server. The transceiver 206 may implement one or more known technologies to support wired or wireless communication with the communication network. In an embodiment, the transceiver 206 may include, but is not limited to, an antenna, a radio frequency (RF) transceiver, one or more amplifiers, a tuner, one or more oscillators, a digital signal processor, a Universal Serial Bus (USB) device, a coder-decoder (CODEC) chipset, a subscriber identity module (SIM) card, and/or a local buffer. The transceiver 206 may communicate via wireless communication with networks, such as the Internet, an Intranet and/or a wireless network, such as a cellular telephone network, a wireless local area network (LAN) and/or a metropolitan area network (MAN). The wireless communication may use any of a plurality of communication standards, protocols and technologies, such as: Global System for Mobile Communications (GSM), Enhanced Data GSM Environment (EDGE), wideband code division multiple access (W-CDMA), code division multiple access (CDMA), time division multiple access (TDMA), Bluetooth, Wireless Fidelity (Wi-Fi) (e.g., IEEE 802.11a, IEEE 802.11b, IEEE 802.11g and/or IEEE 802.11n), voice over Internet Protocol (VoIP), Wi-MAX, a protocol for email, instant messaging, and/or Short Message Service (SMS).

The Input/Output (I/O) unit 208 comprises suitable logic, circuitry, interfaces, and/or code that may be configured to receive an input or transmit an output. The input/output unit 208 comprises of various input and output devices that are configured to communicate with the processor 202. Examples of the input devices include, but are not limited to, a keyboard, a mouse, a joystick, a touch screen, a microphone 208*b*, speaker 208*a* and/or a docking station. Examples of the output devices include, but are not limited to, a display screen and/or a speaker. In an embodiment, the speaker 208*a* may be utilized to play an audio received from a remote device, The audio may correspond to one or more guiding actions provided by the parent who is using the remote device. Further, the microphone 208*b* may be utilized to record audio within a pre-defined distance of the child.

The activity detection unit 210 comprises suitable logic, circuitry, interfaces, and/or code that may be configured to detect one or more activities of the child using the data received from the one or more sensors. The GPS unit 212 comprises suitable logic, circuitry, interfaces, and/or code that may be configured to determine a real-time location of the child. In an instance, when the child is intended to be in class at school hours, and the child attempts a mischievous activity to escape from the school. In such an instance, the GPS unit 212 may be configured to locate deviation of the geographical coordinates on a real-time basis.

The one or more sensors 214 comprises suitable logic, circuitry, interfaces, and/or code that may be configured to detect changes in physiological parameters associated with the child. In an embodiment, the physiological parameters may comprise temperature, blood pressure, and heart rate. The alarm generation unit comprises suitable logic, circuitry, interfaces, and/or code that may be configured to generate one or more alarms that may be provided to a user (parent/guardian) of the remote device 106.

Figure 3:
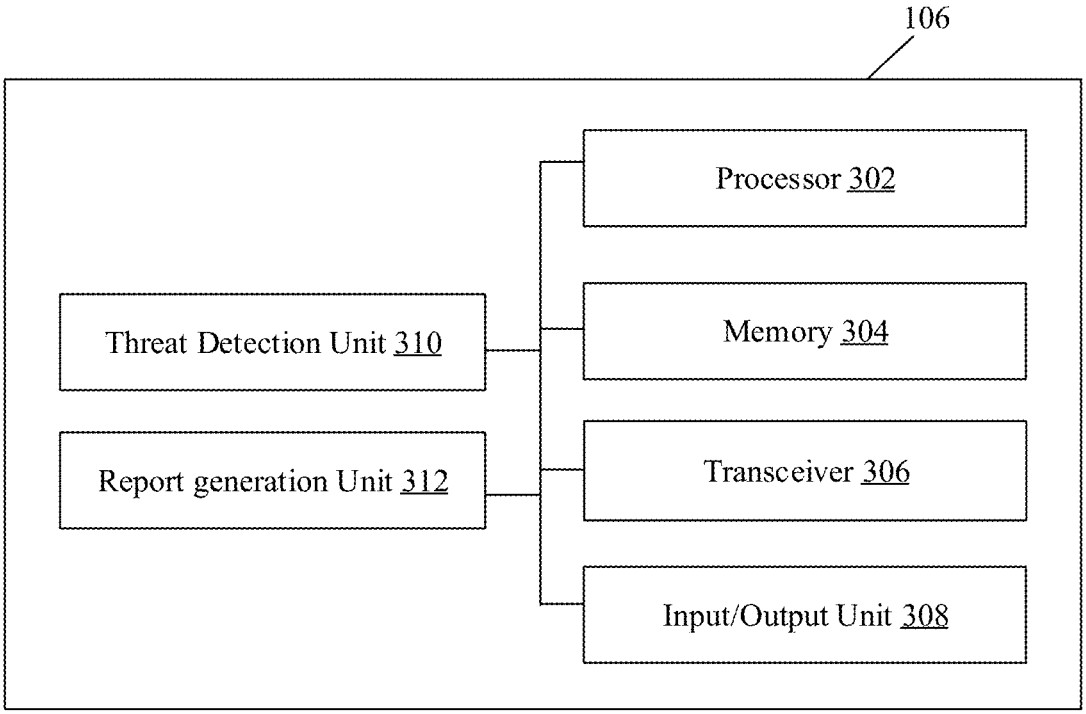
FIG. 3 is a block diagram that illustrates a remote configured to monitor one or more activities of a child, in accordance with some embodiments of the present disclosure.

FIG. 3 is a block diagram that illustrates a remote device 106 configured to monitor one or more activities of a child, in accordance with some embodiments of the present disclosure. The remote device 106 comprises a processor 302, a memory 304, a transceiver 306, an input/output unit 308, a threat detection unit 310, and a report generation unit 312. The processor 302 may be communicatively coupled to the memory 304, the transceiver 306, the input/output unit 308, the threat detection unit 310, and the report generation unit 312.

The processor 302 comprises suitable logic, circuitry, interfaces, and/or code that may be configured to execute a set of instructions stored in the memory 304. The processor 302 may be implemented based on a number of processor technologies known in the art. Examples of the processor 302 include, but not limited to, an X86-based processor, a Reduced Instruction Set Computing (RISC) processor, an Application-Specific Integrated Circuit (ASIC) processor, a Complex Instruction Set Computing (CISC) processor, and/or other processor.

The memory 304 comprises suitable logic, circuitry, interfaces, and/or code that may be configured to store the set of instructions, which may be executed by the processor 302. In an embodiment, the memory 304 may be configured to store one or more programs, routines, or scripts that may be executed in coordination with the processor 302. The memory 304 may be implemented based on a Random Access Memory (RAM), a Read-Only Memory (ROM), a Hard Disk Drive (HDD), a storage server, and/or a Secure Digital (SD) card.

The transceiver 306 comprises of suitable logic, circuitry, interfaces, and/or code that may be configured to transmit one or more guiding actions that may be provided to the child for preventing the child from performing unhygienic/harmful activities. The transceiver 206 may be further configured to receive the report from a cloud server. The transceiver 306 may implement one or more known technologies to support wired or wireless communication with the communication network. In an embodiment, the transceiver 306 may include, but is not limited to, an antenna, a radio frequency (RF) transceiver, one or more amplifiers, a tuner, one or more oscillators, a digital signal processor, a Universal Serial Bus (USB) device, a coder-decoder (CODEC) chipset, a subscriber identity module (SIM) card, and/or a local buffer. The transceiver 306 may communicate via wireless communication with networks, such as the Internet, an Intranet and/or a wireless network, such as a cellular telephone network, a wireless local area network (LAN) and/or a metropolitan area network (MAN). The wireless communication may use any of a plurality of communication standards, protocols and technologies, such as: Global System for Mobile Communications (GSM), Enhanced Data GSM Environment (EDGE), wideband code division multiple access (W-CDMA), code division multiple access (CDMA), time division multiple access (TDMA), Bluetooth, Wireless Fidelity (Wi-Fi) (e.g., IEEE 802.11a, IEEE 802.11b, IEEE 802.11g and/or IEEE 802.11n), voice over Internet Protocol (VoIP), Wi-MAX, a protocol for email, instant messaging, and/or Short Message Service (SMS).

The Input/Output (I/O) unit 308 comprises suitable logic, circuitry, interfaces, and/or code that may be configured to receive an input or transmit an output. The input/output unit 308 comprises of various input and output devices that are configured to communicate with the processor 302. Examples of the input devices include, but are not limited to, a keyboard, a mouse, a joystick, a touch screen, a microphone, and/or a docking station. Examples of the output devices include, but are not limited to, a display screen and/or a speaker.

The threat detection unit 310 comprises suitable logic, circuitry, interfaces, and/or code that may be configured to determine one or more threats that are within nearby surroundings of the child based on the detected one or more activities and the real-time location of the child. In an embodiment, the one or more threat may comprise vaping, smoking, alcohol consumption, child driving a vehicle with co-passengers, excessive noise within pre-defined distance of the child, child driving vehicle without safety gear, and the like.

The report generation unit 312 comprises suitable logic, circuitry, interfaces, and/or code that may be configured to generate a real-time report of the child. In an embodiment, the real-time report comprises information about the detected one or more activities of the child, the real-time location of the child over a time period, and the determined one or more threats.

In operation, the remote device and the wearable device are paired so that the remote device can communicate with the wearable device and vice versa. In an embodiment, the remote device 106 displays the real-time location of the child. In an embodiment, the one or more sensors may be configured to detect one or more activities of the child. In an embodiment, the one or more sensors may comprise temperature sensor 214*a*, blood pressure sensor 214*b*, smoke sensor 214*c*, proximity sensor 214*d*, noise sensor 214*e*, and imaging sensor 214*f* In an embodiment, the one or more sensors may be configured to detect changes in physiological parameters associated with the child. In an embodiment, the physiological parameters may comprise temperature, blood pressure, and heart rate. In an embodiment, sensor data used for "signature" detection may be scrubbed in such a way that it loses its meaning for anything other than the operations associated with monitoring the child. The sensor data may include vital signal data as well as contextual information, such as motion, inertia, movement, environmental, and/or time data.

In an embodiment, the temperature sensor 214*a* may be configured to determine if the temperature of the child is greater than a pre-defined temperature and in such a case one or more alarms may be generated by the alarm generation unit 216. In an embodiment, the blood pressure sensor 214*b* may be configured to determine if the blood pressure of the child is greater than a pre-defined blood pressure threshold and in such a case one or more alarms may be generated by the alarm generation unit 216. In an embodiment, the smoke sensor 214*c* may be configured to detect smoke within a pre-defined proximity of the child. In an embodiment, the smoke sensor 214*c* is further configured to detect at least one of: one or more volatile organic compounds, carbon dioxide, formaldehyde, cadmium, and lead. After identification of such smoke or volatile organic compounds within the vicinity of the child, one or more alarms may be generated by the alarm generation unit 216.

In an embodiment, the proximity sensor 214*d* may be configured to detect the nearby surroundings of the child. In an embodiment, when the child is accompanied by a passenger in a vehicle then such an activity is detected by the proximity sensor 214*d* and in response to such activity detection one or more alarms may be generated by the alarm generation unit 216. In an embodiment, the noise sensor 214*e* may be configured to detect a noise nearby to the child. In an embodiment, when the child is an environment where the noise level is above a pre-defined threshold then the user of the remote device 106 is alerted about the same. In an embodiment, the imaging sensor 214*f* may be configured to capture one or more images of nearby surroundings of the child. In an embodiment, when the child is in a threat situation then the imaging sensor 214*f* may capture real-time images and real-time video of the nearby surroundings. In an embodiment, a microphone 208*b* may be configured to record audio within a pre-defined distance of a child. In an embodiment, the wearable device 102 is wearable by the child.

After sensing data from the one or more sensors, the GPS unit 212 may be configured to identify a real-time location of the child. Further, the GPS unit 212 may be configured to capture and store all the one or more historical locations of the child in the memory 204. In an embodiment, the remote device 106 and the wearable device 102 may be paired so that the remote device 106 displays the real-time location of the child.

Once the data from the one or more sensors is captured, the activity detection unit 210 may be configured to detect one or more activities of the child using the information captured by the one or more sensors. In an embodiment, the one or more sensors comprises temperature sensor 214*a*, blood pressure sensor 214*b*, smoke sensor 214*c*, proximity sensor 214*d*, noise sensor 214*e*, and imaging sensor 214*f* Examples of the one or more detected activities may comprises at least one of: drinking, vaping, smoking, a presence of a threat for the child. The threat of the child may include an active shooter within the vicinity of the child, the child driving a vehicle without using the safety gear, excessive noise within the vicinity of the child.

In an embodiment, one or more threats may be determined that are within nearby surroundings of the child based on the detected one or more activities and the real-time location of the child. In an embodiment, the one or more threats that are within nearby surroundings of the child comprises at least one of: vaping being performed by the child using the smoke sensor and alarming the remote device about a vaping threat; the child driving a vehicle with co-passengers, harmful nearby surroundings of the child detected using the proximity sensor; noise level above a pre-defined threshold within a pre-defined distance from the child that is detected using the noise sensor; images captured by the imaging unit that indicate nearby surroundings of the child, the child is not wearing a safety gear while riding a vehicle Further, the threat may include an active shooter who is suspected to shoot the child and is identified using the one or more images of nearby surroundings that identify the active shooter. Further, position of an active shooter who is suspected to shoot the child may be triangulated using the GPS unit and the one or more images. In an embodiment, the position and the captured images are transmitted to a remote server that is accessed by at least one of: an enforcement agency, an educational institution and the user of the remote device.

In response to determining of threats, the alarm generation unit 216 may be configured to generate one or more alarms and send to remote device 106. In an embodiment, the one or more alarms are provided using at least one of: tactile feedback, audio sound, display alert. "Alert" is an audible, visual and/or vibrational signal or text/graphic message (including a badge or icon) that is displayed on a telecommunications device by a wireless signal from the server or sensor hub in response to a potential incident involving a registered user.

Further, the threat detection unit 310 may be configured to receive one or more historical locations of the child and the real-time location of the child via the transceiver 306. The threat detection unit 310 may be configured to determine a movement pattern of the child based on one or more historical locations of the child and the real-time location of the child. Further, the threat detection unit 310 may be configured to determine a deviation of the real-time location of the child within a pre-defined time interval based on one or more pre-defined rules associated with the movement pattern. In an embodiment, the real-time location of the child may be time stamped and also include details about date and day.

For example, the child should be in the school vicinity between 9 am and 4 pm. However, based on the movement pattern of the child it was observed that the child was not within the school for 2 hours during the time of 9 am and 4 pm. This indicates that the child bunked the school for 2 hours and was at some other location that is pointed out by the GPS unit. Such deviations may be identified and then reported to the parent/guardian who is using the remote device 106.

Further, after the threats are determined, the report generation unit 312 may be configured to generate a real-time report of the child. The real-time report comprises information about the detected one or more activities of the child, the real-time location of the child over a time period, and the determined one or more threats. In an embodiment, the remote device 106 is communicably coupled to the wearable device 102 and the remote device 106 is configured to control one or more operations of the inconspicuous wearable device. In an embodiment, the one or more operations may comprise controlling the speaker of the wearable device 102 and content played using the speaker, and controlling operation of the one or more sensors.

In an embodiment, the wearable device 102 further comprises a lock and the lock may be operated by the remote device 106. In an embodiment, the remote device 106 is wearable by the user (parent/guardian) of the remote device 106.

After generation of the report and/or receiving the one or more alarms generated by the wearable device 102, the user (parent/guardian) may evaluate the report and the alarms and then transmit one or more guiding actions to the wearable device 102 via the transceiver 306. Further, the wearable device 102 may receive the one or more guiding actions, via the transceiver 206, associated with the child and playback the guiding actions via the speaker 208*a*. In an embodiment, the one or more guiding actions are provided by the user of the remote device. In an embodiment, the one or more guiding actions discourage the child from performing unhygienic/harmful activities.

For example, when the parent receives an alert that smoke is present in the vicinity of the child then the parent can control the imaging sensor and can capture one or more images of the nearby surroundings of the child to get more context on why the smoke was detected. If from the images it is identified that the child is smoking then the parent can send an audio message comprising "Do not Smoke. It is harmful" to the wearable device 102 and such a message would be played on the wearable device 102 to prevent the child from smoking.

In another example, when the parent receives report and finds out that there is a deviation in the movement pattern of the child within a pre-defined time interval based on one or more pre-defined rules then the parent may call the child and seek and explanation for the same. Also, the parent can control the image sensor and capture images during the time of the deviation and find out where the child went during the deviation time.

In another example, when the parent receives an alert that the child has not worn a safety gear while driving a vehicle then the parent can immediately call the child and ask him/her to do so or may even send an audio message to the wearable device 102 and then confirm if the child adhered to the instructions provided by the parent.

In another example, when the parent receives an alert that the child is vaping or within vicinity of other people who are vaping then the then the parent can send an audio message comprising "Do not Vape. It is harmful" to the wearable device 102 and such a message would be played on the wearable device 102 to prevent the child from vaping.

In another example, when the parent receives an alert that the child is driving a vehicle with co-passengers then the parent can send an audio message comprising "Do not drive with co-passengers" to the wearable device 102 and such a message would be played on the wearable device 102 to prevent the child from driving along with co-passengers.

In another example, when the parent receives an alert that there is excessive noise within the vicinity of the child then the parent can control the image sensor to identify where the child has gone and get the location from the mobile device and ensure that there is no harm to the child. If a harm is felt by the parent for the child, then the parent can call the child and ask them to move away from such a location or the parent can send an audio message comprising "Please do not stay at this place go to some other place where there is less noise" to the wearable device 102 and such a message would be played on the wearable device 102 to prevent the child from any potential damage to the ears.

In another example, when the parent receives one or more images of nearby surroundings of the child which identifies an active shooter who is suspected to shoot the child, then the parent can inform the at least one of: an enforcement agency, an educational institution about the same. Also, the position of an active shooter may be triangulated based on the location of the child and the one or images in which the active shooter has been identified.

In an embodiment, the real-time report of the child may be transmitted to a cloud server 108. In an embodiment, when the remote device 106 is non-functional, then the real-time report of the child is transmitted and is accessed on recovery of a functioning of the remote device 106.

Figure 4:
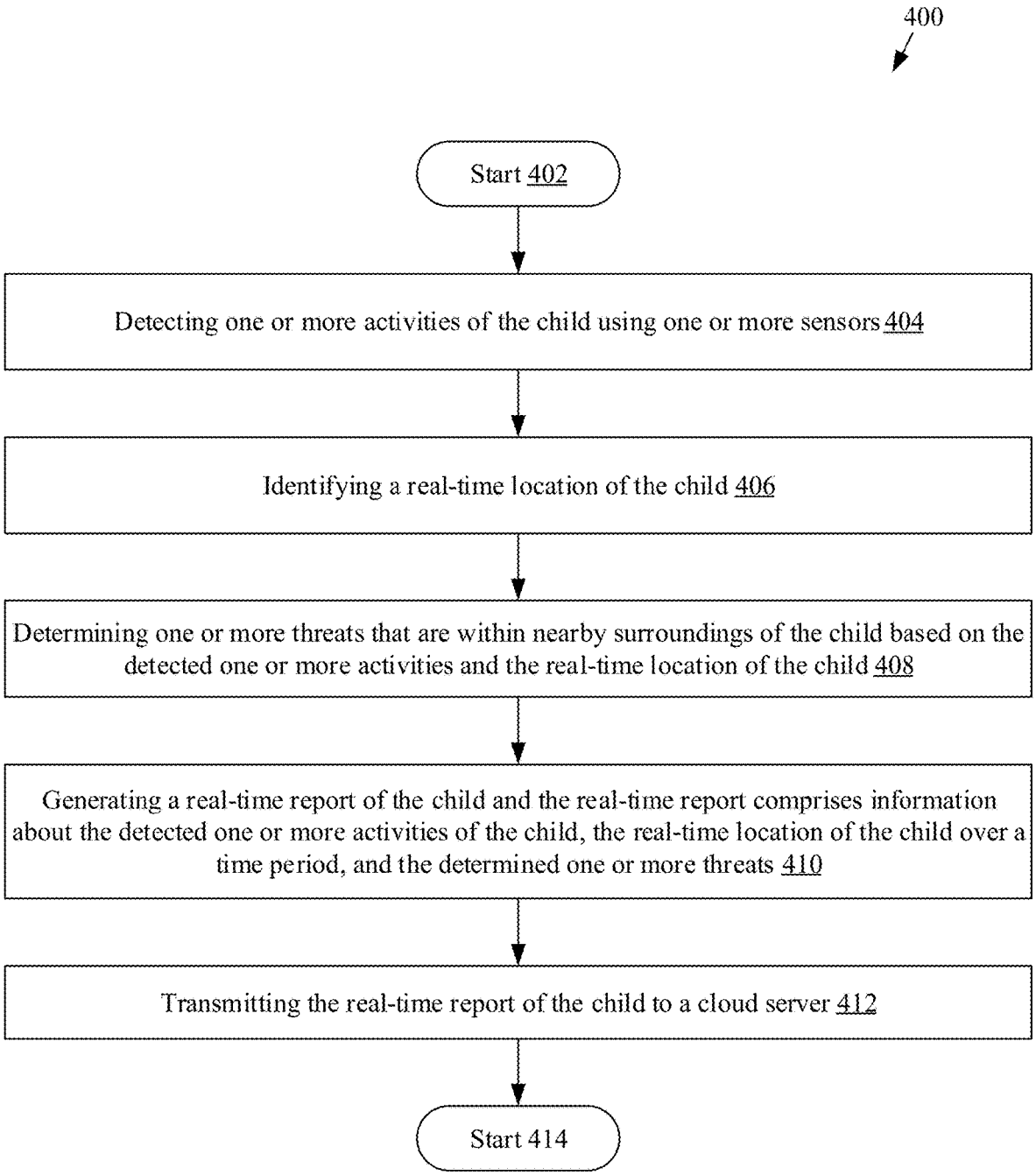
FIG. 4 depicts a flowchart illustrating a method performed by the automated child monitoring system for monitoring an activity of a child, in accordance with some embodiments of the present disclosure.

FIG. 4 depicts a flowchart illustrating a method 400 performed by the automated child monitoring system for monitoring an activity of a child, in accordance with some embodiments of the present disclosure. The method starts at step 402 and proceeds to step 404.

At step 404, the automated child monitoring system may be configured to detect one or more activities of the child using one or more sensors. In an embodiment, the one or more sensors comprises temperature sensor, blood pressure sensor, smoke sensor, proximity sensor, noise sensor, and imaging sensor. At step 406, the automated child monitoring system may be configured to identify a real-time location of the child. At step 408, the automated child monitoring system may be configured to determine one or more threats that are within nearby surroundings of the child based on the detected one or more activities and the real-time location of the child. At step 410, the automated child monitoring system may be configured to generate a real-time report of the child. In an embodiment, the real-time report comprises information about the detected one or more activities of the child, the real-time location of the child over a time period, and the determined one or more threats. At step 412, the automated child monitoring system may be configured to transmit the real-time report of the child to a cloud server. Control passes to end step 404.

Furthermore, one or more computer-readable storage media may be utilized in implementing embodiments consistent with the present invention. A computer-readable storage medium refers to any type of physical memory on which information or data readable by a processor may be stored. Thus, a computer-readable storage medium may store instructions for execution by one or more processors, including instructions for causing the processor(s) to perform steps or stages consistent with the embodiments described herein. The term "computer-readable medium" should be understood to include tangible items and exclude carrier waves and transient signals, i.e., non-transitory. Examples include Random Access Memory (RAM), Read-Only Memory (ROM), volatile memory, nonvolatile memory, hard drives, Compact Disc (CD) ROMs, Digital Video Disc (DVDs), flash drives, disks, and any other known physical storage media.

In another aspect, the control server may control the detection sensors collectively, individually, or group by group. For example, several the detection sensors may be worn by several individuals, may be installed at the same site or different sites or may be a combination of individual wearers and onsite devices. The control server may use a query language to request data from the database. The query language may be SQL, MySQL, SSP, C, C++, C#, PHP, SAP, Sybase, Java, JavaScript, or any language, which can be used to request data from a database. In another aspect, even when several detection sensors are in use, the control server may control them differently because one the detection sensor may have different parameters for identifying bullying and vaping from those of another the detection sensor due to different wearers or installation locations at the site. For example, the detection sensor worn on an individual may have parameters different from those of the detection sensor installed at a bathroom.

Figure 5:
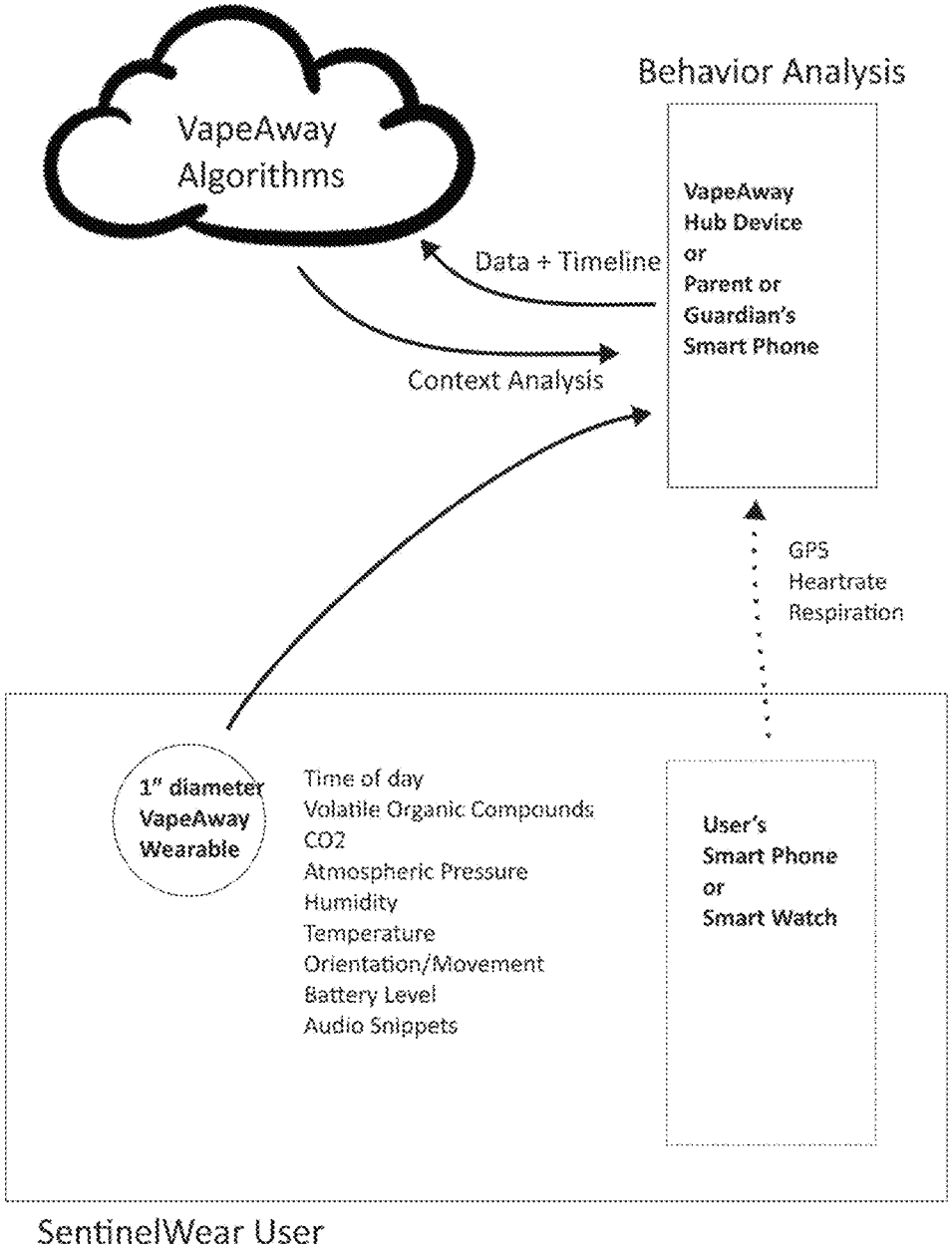
FIG. 5 depicts a block diagram that illustrates an automated child monitoring system in which one or more embodiments of the method and the system may be implemented using sensor data and context to the wearable device cloud to chart the users's behavior.
Figure 6:
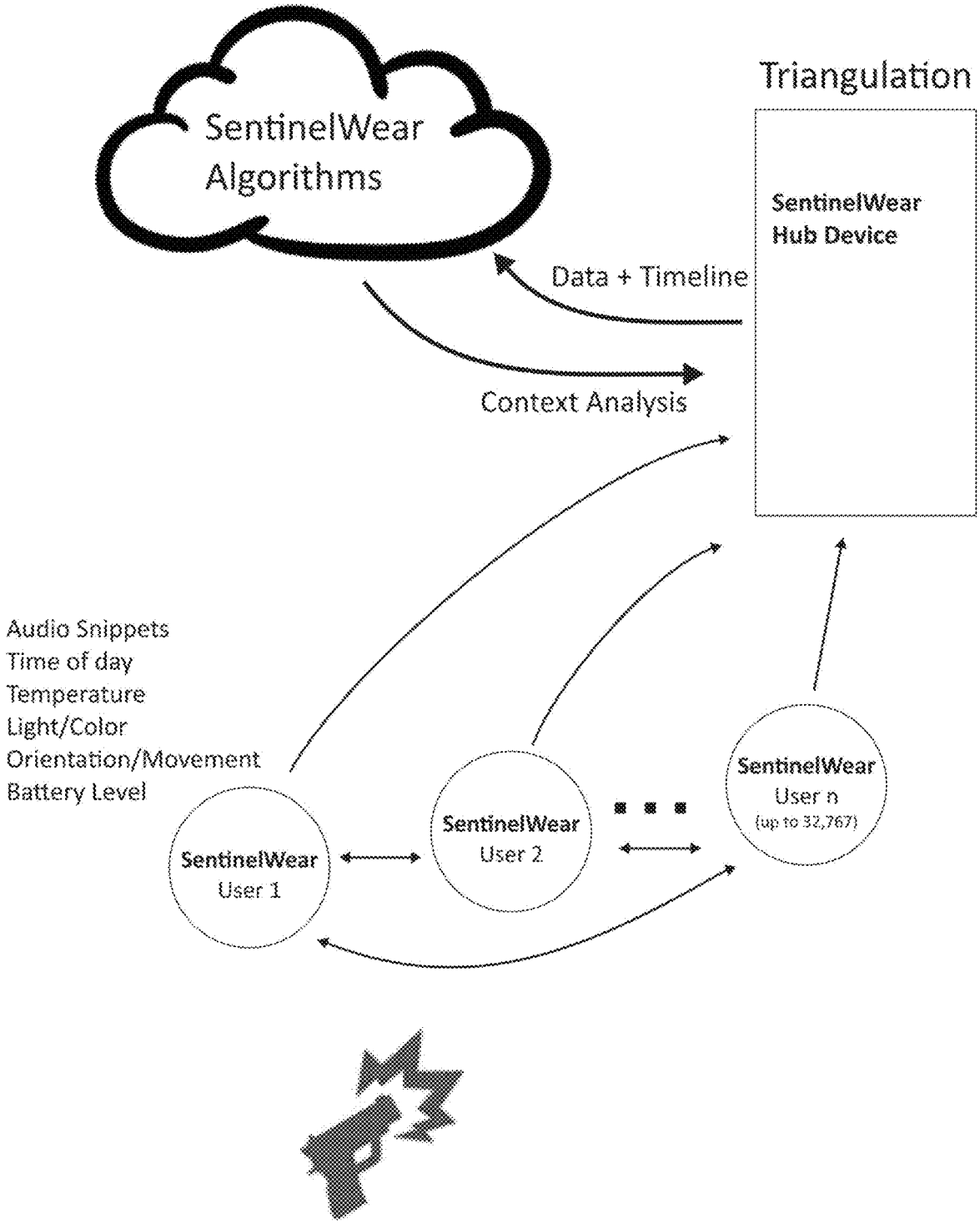
FIG. 6 depicts a block diagram that illustrates an alternate monitoring system in which one or more embodiments of the method and the system may be implemented using sensor data and context to the wearable device cloud to alert to environmental dangers.

FIG. 5 depicts a block diagram that illustrates an automated child monitoring system in which one or more embodiments of the method and the system may be implemented using sensor data and context to the wearable device cloud to chart the users's behavior; and FIG. 6 depicts a block diagram that illustrates an alternate monitoring system in which one or more embodiments of the method and the system may be implemented using sensor data and context to the wearable device cloud to alert to environmental dangers.

The network interface may be configured to connect to a network such as a local area network (LAN) consisting of a wired network and/or a wireless network, a wide area network (WAN), a wireless mobile network, a Bluetooth network, and/or the internet.

In one embodiment, the computing device may receive, through the network interface, detection results for the activity detection unit 210, for example, detected sound, and history data, which is time-series data including detected sounds and detected air quality from the detection sensor for the whole running times or a predetermined period. The mobile computing device may receive updates to its software, for example, the application, via the network interface. The mobile computing device may also display notifications on the display that a software update is available.

The input device may be any device by means of which a user may interact with the mobile computing device, such as, for example, a mouse, keyboard, foot pedal, touch screen, and/or voice interface. The output module may include any connectivity port or bus, such as, for example, parallel ports, serial ports, universal serial busses (USB), or any other similar connectivity port known to those skilled in the art. The application may be one or more software programs stored in the memory and executed by the processor of the computing device. The application may be installed directly on the computing device or via the network interface. The application may run natively on the computing device, as a web-based application, or any other format known to those skilled in the art.

In one embodiment, the application will be a single software program having all of the features and functionality described in the present disclosure. In other aspect, the application may be two or more distinct software programs providing various parts of these features and functionality. Various software programs forming part of the application may be enabled to communicate with each other and/or import and export various settings and parameters relating to the identification of bullying, sleep apnea, and vaping. The application communicates with a user interface which generates a user interface for presenting visual interactive features to the notification subscribers 150 or the clients. For example, the user interface may generate a graphical user interface (GUI) and output the GUI to the display to present graphical illustrations.

The terms "an embodiment", "embodiment", "embodiments", "the embodiment", "the embodiments", "one or more embodiments", "some embodiments", and "one embodiment" mean "one or more (but not all) embodiments of the invention(s)" unless expressly specified otherwise. The terms "including", "comprising", "having" and variations thereof mean "including but not limited to", unless expressly specified otherwise. The terms "a", "an" and "the" mean "one or more", unless expressly specified otherwise.

ADVANTAGES

The disclosed claimed limitations and the disclosure provided herein provides an automated child monitoring system. The wearable device allows a parent and a child to remain in contact and that allows the parent to monitor the child's activity and location. Further, the child monitoring system detects activities of a child using sensors and alerts the parent when the child is performing a harmful activity such as, drinking, smoking, vaping, and like or if the child is in a dangerous situation is desired. Further, a child monitoring system can communicated with the child and discourage the child from performing such harmful activities.

Additionally, the child monitoring system may determine a movement pattern of the child based on one or more historical locations of the child and the real-time location of the child and further determine a deviation of the real-time location of the child within a pre-defined time interval based on one or more pre-defined rules associated with the movement pattern and thus can identify if a child is in any dangerous situation or is performing any illegal/harmful activities. Thus, the disclosed method and system tries to overcome to technical problem of monitoring a child remotely and preventing a child from performing illegal/harmful activities.

In light of the above mentioned advantages and the technical advancements provided by the disclosed method and system, the claimed steps as discussed above are not routine, conventional, or well understood in the art, as the claimed steps enable the following solutions to the existing problems in conventional technologies. Further, the claimed steps clearly bring an improvement in the functioning of the device itself as the claimed steps provide a technical solution to a technical problem.

A description of an embodiment with several components in communication with each other does not imply that all such components are required. On the contrary, a variety of optional components are described to illustrate the wide variety of possible embodiments of the invention.

Finally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based here on. Accordingly, the embodiments of the present invention are intended to be illustrative, but not limiting, of the scope of the invention, which is set forth in the following claims.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The present disclosure may be realized in hardware, or a combination of hardware and software. The present disclosure may be realized in a centralized fashion, in at least one computer system, or in a distributed fashion, where different elements may be spread across several interconnected computer systems. A computer system or other apparatus adapted for carrying out the methods described herein may be suited. A combination of hardware and software may be a general-purpose computer system with a computer program that, when loaded and executed, may control the computer system such that it carries out the methods described herein. The present disclosure may be realized in hardware that comprises a portion of an integrated circuit that also performs other functions.

A person with ordinary skills in the art will appreciate that the systems, modules, and sub-modules have been illustrated and explained to serve as examples and should not be considered limiting in any manner. It will be further appreciated that the variants of the above disclosed system elements, modules, and other features and functions, or alternatives thereof, may be combined to create other different systems or applications.

Those skilled in the art will appreciate that any of the aforementioned steps and/or system modules may be suitably replaced, reordered, or removed, and additional steps and/or system modules may be inserted, depending on the needs of a particular application. In addition, the systems of the aforementioned embodiments may be implemented using a wide variety of suitable processes and system modules, and are not limited to any particular computer hardware, software, middleware, firmware, microcode, and the like. The claims can encompass embodiments for hardware and software, or a combination thereof.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment disclosed, but that the present disclosure will include all embodiments falling within the scope of the appended claims.

What is claimed is:

1. An automated child monitoring system, the automated child monitoring system comprising:

an inconspicuous wearable device comprising:

a hardware processor;

a memory communicatively coupled to the hardware processor;

a speaker configured to play an audio received from a remote device via a transceiver;

a microphone configured to record audio within a pre-defined distance of a child, wherein the inconspicuous wearable device is wearable by the child;

one or more sensors configured to detect one or more activities of the child, wherein the one or more sensors are configured with one or more pre-defined threshold values for one or more pre-defined rules associated with the activities;

wherein the one or more activities comprises at least one of: drinking, vaping, smoking, a presence of a threat for the child wherein in response to detection above the one or more pre-defined threshold values for one or more pre-defined rules of such activity detection, one or more alerts are generated; and a hub unit communicably coupled to the inconspicuous wearable device, wherein the hub unit is configured to control one or more operations of the inconspicuous wearable device, wherein the hub unit is configured to generate a real-time report of the child and further provide one or more alarms to a user of the remote device, wherein when the remote device is non-functional, then the real-time report of the child is transmitted and is accessed on recovery of a functioning of the remote device.

2. The automated child monitoring system of claim 1, wherein the one or more operations comprise controlling the speaker of the inconspicuous wearable device and content played using the speaker, controlling operation of the one or more sensors.

3. The automated child monitoring system of claim 1, wherein the one or more alarms are provided using at least one of: tactile feedback, audio sound, display alert.

4. The automated child monitoring system of claim 1, wherein the inconspicuous wearable devices are paired so that the remote device displays the location of the child.

5. The automated child monitoring system of claim 1, wherein the inconspicuous wearable device further comprises a lock, wherein the lock is operated by the remote device, wherein the remote device is wearable by the user of the remote device.

6. The automated child monitoring system of claim 1, wherein the one or more sensors are configured to detect changes in physiological parameters associated with the child, wherein the physiological parameters comprise temperature, blood pressure, and heart rate.

7. The automated child monitoring system of claim 1, further comprising determining a movement pattern of the child based on one or more historical locations of the child and the real- time location of the child.

8. The automated child monitoring system of claim 7, further comprising determining a deviation of the real-time location of the child within a pre-defined time interval based on one or more pre-defined rules associated with the movement pattern.

9. The automated child monitoring system of claim 1, wherein the inconspicuous wearable device receives one or more guiding actions associated with the child via the speaker, wherein the one or more guiding actions are provided by the user of the remote device, and wherein the one or more guiding actions discourage the child from performing unhygienic/harmful activities.

10. The automated child monitoring system of claim 1, wherein the one or more sensors comprises temperature sensor, smoke sensor, noise sensor, and imaging sensor.

11. The automated child monitoring system of claim 10, wherein the smoke sensor is configured to detect smoke within a pre-defined proximity of the child, wherein the smoke sensor is further configured to detect at least one of: one or more volatile organic compounds, carbon dioxide, formaldehyde, cadmium, and lead.

12. The automated child monitoring system of claim 10, wherein the proximity sensor is configured to detect the nearby surroundings of the child, wherein when the child is accompanied by a passenger in a vehicle then such an activity is detected by the proximity sensor.

13. The automated child monitoring system of claim 10, wherein the noise sensor is configured to detect a noise nearby to the child, wherein when the child is an environment where the noise level is above a pre-defined threshold then the user of the remote device is alerted about the same.

14. The automated child monitoring system of claim 10, wherein the imaging sensor is configured to capture one or more images of nearby surroundings of the child, wherein when the child is in a threat situation then the imaging sensor captures real-time images and real-time video of the nearby surroundings.

15. A method for monitoring an activity of a child; the method comprising:

detecting, by an automated child monitoring system, one or more activities of the child using one or more sensors, wherein the one or more sensors comprises temperature sensor, smoke sensor, proximity sensor, noise sensor, and imaging sensor, wherein the one or more sensors are configured with one or more pre-defined threshold values for one or more pre-defined rules associated with the activities;

wherein in response to detection above the one or more pre-defined threshold values for one or more pre-defined rules of such activity detection, one or more alerts are generated; and identifying, by the automated child monitoring system, a real-time location of the child;

determining, by the automated child monitoring system, one or more threats that are within nearby surroundings of the child based on the detected one or more activities and the real-time location of the child; and generating, by the automated child monitoring system, a real-time report of the child, wherein the real-time report comprises information about the detected one or more activities of the child, the real-time location of the child over a time period, and the determined one or more threats; and transmitting, by the automated child monitoring system, the real-time report of the child to a cloud server.

16. The method of claim 15, wherein determining the one or more threats that are within nearby surroundings of the child comprises at least one of:

detecting, by the automated child monitoring system, vaping being performed by the child using the smoke sensor and alarming a remote device about a vaping threat;

determining, by the automated child monitoring system, if the child is driving a vehicle with co-passengers using proximity sensor and alarming the remote device about a non-compliant driving threat;

detecting, by the automated child monitoring system, the nearby surroundings of the child using the proximity sensor;

detecting, by the automated child monitoring system, a noise level within a pre-defined distance from the child using the noise sensor and alarming the remote device when the noise level is above a pre-defined threshold; and capturing, by the automated child monitoring system, one or more images of nearby surroundings of the child using an imaging device;

determining, by the automated child monitoring system, whether the child is wearing a safety gear while riding a vehicle;

triangulating, by the automated child monitoring system, a position of an active shooter who is suspected to shoot the child and capturing one or more images of the active shooter and further transmitting the position and the captured images to a remote server that is accessed by at least one of: an enforcement agency, an educational institution and the user of the remote device, wherein when the remote device is non-functional, then the real-time report of the child is transmitted and is accessed on recovery of a functioning of the remote device.

* * * * *